US005841136A

United States Patent [19]

Holle et al.

[11] Patent Number: 5,841,136

[45] Date of Patent: Nov. 24, 1998

[54] DEVICE AND METHOD FOR INTRODUCTION OF SAMPLE SUPPORTS INTO A MASS SPECTROMETER

[75] Inventors: Armin Holle, Oyten; Claus Köster, Lilienthal; Jens Rebettge, Schwanewede, all of Germany

[73] Assignee: Bruker-Franzen Analytik, GmbH, Bremen, Germany

[21] Appl. No.: 890,981

[22] Filed: Jul. 10, 1997

[30] Foreign Application Priority Data

Jul. 12, 1996 [DE] Germany ..... 196 28 112.1

[51] Int. Cl.[6] ..... H01J 47/04

[52] U.S. Cl. ..... 250/288

[58] Field of Search ..... 250/288, 288 A, 250/281, 282

[56] References Cited

U.S. PATENT DOCUMENTS 4,076,982 2/1978 Ritter et al. ..... 250/288
4,594,506 6/1986 Ghaderi ..... 250/288
5,037,611 8/1991 Ledford, Jr. ..... 250/288
5,498,545 3/1996 Vestal ..... 250/288

FOREIGN PATENT DOCUMENTS 2150289 6/1985 United Kingdom .
9603768 2/1996 WIPO .

*Primary Examiner*—Kiet T. Nguyen

[57] ABSTRACT

A system and a method for the introduction of sample supports, which hold large numbers of analysis samples, into the ion source region of a mass spectrometer. The sample supports are especially intended for the ionization method using matrix-assisted desorption through laser bombardment (MALDI). The system consists of using an evacuable, sealable and removable cassette which, instead of using a through-passage lock chamber with two lock valves, can be attached in a simple manner to the entrance opening for the ion source of the mass spectrometer. Only the entrance opening has a lock valve, and the expensive second lock valve in the lock chamber is no longer needed. The cassette can also be used for protected transport and for storage of the sample supports, and in particular for storage of the samples under protective gas or vacuum.

7 Claims, 1 Drawing Sheet

DEVICE AND METHOD FOR INTRODUCTION OF SAMPLE SUPPORTS INTO A MASS SPECTROMETER

Figure 1:
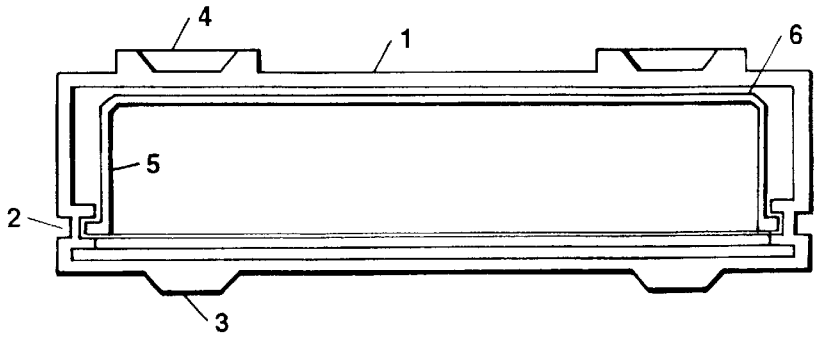

The invention is related to a device and a method for the introduction of sample supports, which hold large numbers of analysis samples, into the ion source region of a mass spectrometer. The sample supports are especially intended for the ionization method using matrix-assisted desorption through laser bombardment (MALDI).

The invention consists of using an evacuable, sealable and removable cassette which, instead of using a through-passage lock chamber with two lock valves, can be attached in a simple manner to the entrance opening for the ion source of the mass spectrometer. Only the entrance opening has a lock valve, and the expensive second lock valve in the lock chamber is no longer needed. The cassette can also be used for protected transport and for storage of the sample supports, and in particular for storage of the samples under protective gas or vacuum.

PRIOR ART

The ionization of biomolecular or polymer samples using matrix-assisted desorption by means of bombardment with short light flashes from a pulsed laser has found wide acceptance in recent years and is used especially for time-of-flight mass spectrometers, but also in quadrupole RF ion traps or in ion cyclotron resonance spectrometers. Besides this ionization method known as "MALDI" (matrix-assisted laser desorption/ionization), other methods for ionizing large biomolecules off surfaces have also become known.

A common feature of these ionization methods is that samples applied to the surface of a sample support must be introduced into the vacuum system of the mass spectrometer. Prior art here is that a relatively large number of samples (about 10 to 100) are introduced together on a support, and the sample support is moved within the vacuum system in such a way that the required sample is situated specifically in the focus of the laser's lens system.

Progress in the MALDI technique will permit automation of sample ionization in the future which until now can only be controlled by the user via video-microscopic observation of the sample. This automation opens up the long desired possibility for the fast analysis of some tens of thousands of samples per day. Massive-parallel handling of samples was introduced long ago in other areas of biochemistry and molecular genetics. Larger sample supports than used nowadays will be required as well as a high density of samples on the sample support.

Up to now, various sample supports of up to 30 millimeters in diameter, in other systems up to 50 by 50 millimeters, have been used. These are too small for future demands. However from the current perspective, it seems completely possible to find room for tens of thousands of samples on a sample support with the standard established size of so-called microtiter plates. The body size of these plates is 80 by 125 millimeters, with a usable surface of 72 by 108 millimeters. Today there are already commercially available sample processing systems which work with microtiter plates of this size.

In biochemistry and molecular genetics, these microtiter plates have become established for parallel processing of many samples. These originally contained 96 small exchangeable reaction containers in a 9 mm grid on the usable surface of 72 by 108 millimeters. Today, plates of the same size with 384 reaction containers imbedded solidly in plastic in a 4.5 mm grid have become industry standard. Plates with 864 reaction containers in a 3 mm grid are already being discussed. Parallel processing in high numbers consists not only in working with only one such microtiter plate, but rather synchronously with a large number of such plates. For example, during simultaneous treatment of 120 such plates in a single PCR apparatus (PCR=polymerase chain reaction), more than 46,000 DNA samples could be multiplied a billion times simultaneously.

Nevertheless, it has been a disadvantage up to now that such a large sample support also requires a very large lock chamber on the mass spectrometer, with a large, high-vacuum-tight sealable lock-gate valve for the introduction of sample supports into the lock, and with a further, high-vacuum-tight sealable lock-gate valve of the same size for the mass spectrometer. The current prior art is described in U.S. Pat. No. 5,498,545, in which a system is presented which can hold several sample supports of about 50 by 50 millimeters in size in readiness in a lock chamber, while one sample support each is located in the analysis position in the mass spectrometer. This very complicated and expensive system is intended to permit automatic analysis of a large number of samples on each of a large number of sample supports, with automatic feed of the sample supports.

However, since it must be expected that so many samples will be placed on sample supports in the future, that the mass spectrometer will require an entire 24 hour day for the analysis of samples even with high speed analysis methods, such a complicated feeding device for the sample supports does not seem to make sense for the majority of applications. Changing the sample supports, which only takes a few minutes, can also be done manually. In this way, the cost of the unit is reduced and operational security is increased.

The number of samples on a sample support is mostly limited today by the long time required for the biochemical preparation of the samples and by the perishability of the samples. For many MALDI methods, matrix substances are used which oxidize or hydrolize when exposed for long periods to the air and thereby lose their effectiveness for the MALDI process. Also biomolecular samples are often unstable, often must be stored only cooled in solution and cannot be exposed for hours to laboratory air.

Nevertheless, it already seems to be possible today to place an extreme number of samples on a sample support, as represented in a concurrent patent application (Reference BFA 39/96). This is also possible for very sensitive samples if application takes place automatically under protective gas. Thus it certainly seems possible to place about 10,000 to 50,000 samples on a surface of about 8 by 12 centimeters for the MALDI process and to analyze them automatically in respect to certain problems within a period of about 24 hours. Required for this is an analysis time of a few, if possible less than two, seconds per sample. Apparatuses of this type are used for questions of genotyping and for mutation screening. Storage of the samples in a vacuum for a longer period of time is safe, the samples can neither oxidize nor hydrolize in this way. They also do not normally need to be cooled in a dry condition.

OBJECTIVE OF THE INVENTION

It is the objective of the invention to find a device and method by which large sample supports can be introduced simply and safely without a complicated lock mechanism into the vacuum system of a mass spectrometer. In particular, the number of expensive and large, high-vacuum-tight lock-gate valves is to be reduced. It is a further objective of the invention to protect the sample supports and the samples found on them even outside the vacuum system. It should also be kept in mind that charging a sample support with so many samples, that their analysis takes an entire 24 hour day, does not necessarily demand an expensive, completely automatic lock system for many sample supports. The introduction of sample supports, which only takes a few minutes, can be done more easily and safely by hand. On the other hand, a simple automatic mechanism for the feeding of several sample supports for special purposes should not be impeded, but should also be possible.

DESCRIPTION OF THE INVENTION

It is the basic idea of the invention to use a removable, evacuable cassette instead of the standardly used through-passage lock chamber with its two high-vacuum-tight lock-gate valves. The cassette can be easily attached on the outside of the entrance opening to the ion source, vacuum-tight with only one lock-gate valve. This cassette, in which the sample support is located, is opened briefly by removing the lid and immediately attached to the entrance opening of the mass spectrometer where the only vacuum-tight lock-gate valve is located behind the introduction opening. A semi-soft rubber seal, and perhaps also a simple spring catch, ensures vacuum-tight flange mounting of the cassette which is pressed independently with sufficient force by the external air pressure. Even sensitive samples generally survive the brief exposure to air necessary for the flange mounting procedure.

The cassette is then immediately evacuated, for which there is a pump line which leads to a prevacuum pump, located in the aerea of the the introduction opening. A simple shutoff valve in the pump line eases evacuation. After evacuation, the lock-gate valve in the introduction opening is then opened and the sample support plate is grasped by a simple movement mechanism and pulled into the mass spectrometer. The lock-gate valve may for example be a flap valve, the closing pressure of which is supported by the external air pressure. The movement mechanism for the sample support may be part of an x-y movement device with which the individual samples can be brought into the focal point of the laser's lens system.

In biochemistry and molecular genetics, as described above, the microtiter plates have become established themselves for parallel processing of many samples. It is now a further idea of the invention to use this plate size for the sample supports as well, but to apply many more samples by using a much narrower grid than can be placed on a microtiter plate.

It is a further idea of the invention that the cassette holds and thereby protects the sample support during transport to the mass spectrometer and also during storage until analysis time. The cassette can be simply provided with a lid for this purpose and can be filled with protective gas to protect the sensitive samples during longer storage or during transport. In special cases, the cassette can even be evacuated. The flat cassette is designed to be stacked so that many cassettes can be stored one on top of the other.

For very sensitive samples which must not be exposed to the air even briefly, a special sealing lid can be used which contains a diffusion-tight lock-gate valve. This sealing lid can be flange mounted onto the entrance opening. After pumping out the space around the entrance opening, the lock-gate valve on the sealing lid is opened. Then the escaping protective gas is pumped out and only then is the lock gate to the ion source opened in order to move the sample support in.

FURTHER ADVANTAGES OF THE INVENTION

Future sample supports will already be preprepared for the MALDI process. On the surface of the sample supports, the necessary substances have already been applied in a thin layer for the MALDI process and it is only necessary to apply the sample substances. The substances required for the MALDI process are also sensitive to destruction by touching or by longer storage periods if exposed to air, therefore it is practical to store the preprepared sample supports in the cassettes.

The cassettes at last make it possible to manufacture MALDI sample supports industrially and prepare them with the MALDI layer, store them in cassettes and send them.

Certain special MALDI methods operate at temperatures far below zero degrees Celsius, for example, in order to ionize the sample using water vapor, the water being introduced into the vaccum system as ice on the sample support. These MALDI methods may also be performed on the sample supports through deep-cooled processing of the sample. The sample supports here have a thick sample base, worked into the sample support, with a high thermal capacity. The sample supports are then inserted in deep-cooled cassettes and can be stored frozen in the cassette. The thermally insulated receptacle for the sample support on the movement device in the vacuum allows—without further cooling—hours of work with these deep-cooled sample supports.

The cassettes also allow automatic feeding of a large number of sample supports if this should be necessary for automatic work over weekends, or for work with sample supports which have only a low number of samples. The cassettes can be provided with special sliding grooves on their outside which are suitable for introduction into magazine systems. The magazine systems can then be flange mounted onto the mass spectrometer, while an automatically operating movement device feeds the cassette into the entrance opening, flange mounts these and initiates the transfer of the sample supports to the ion source.

SHORT DESCRIPTION OF THE FIGURES

FIG. 1 shows a cross section through a cassette (1). The cassettes can be inserted with the sliding groove (2) into a special magazine or stacked on top of one another with the feet (3) in the recesses (4). The cassette (1) contains the sample support (5), which is designed as a hollow form, and has a metallized surface (6) on its upper side for receiving the MALDI layer and the samples.

Figure 2:
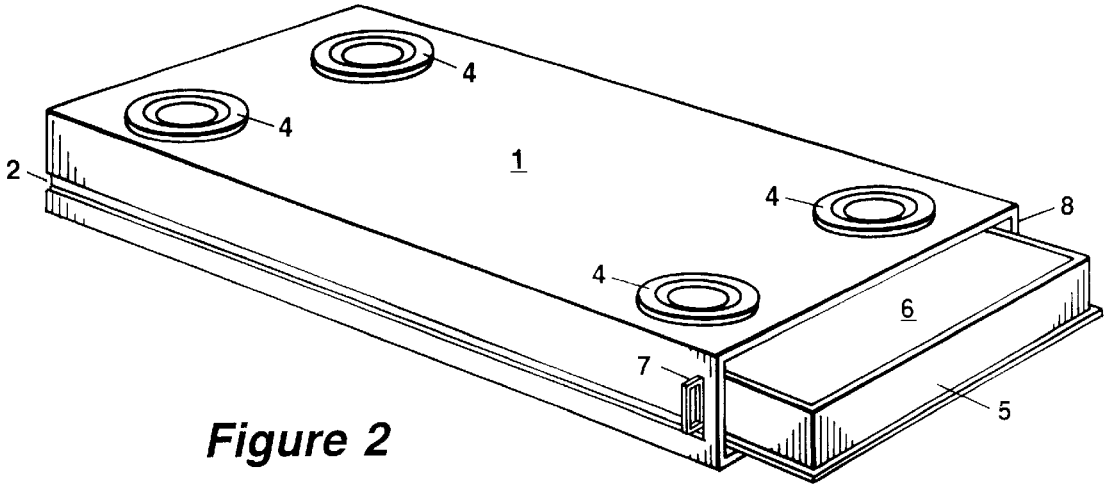

FIG. 2 shows a three-dimensional view of the cassette (1), from which the sample support (5) projects with the MALDI layer (6). The sliding groove (2) helps insert this cassette into a magazine.

The recesses (4) receive the feet of a cassette stacked on top. The fastening eyelet (7) helps the cassette click into place when flange mounting onto the entrance opening of the mass spectrometer. The opening on the cassette with the projecting sample support can be sealed airtight using a simple lid closure. The lid closure also catches on the fastening eyelet (7).

Figure 3:
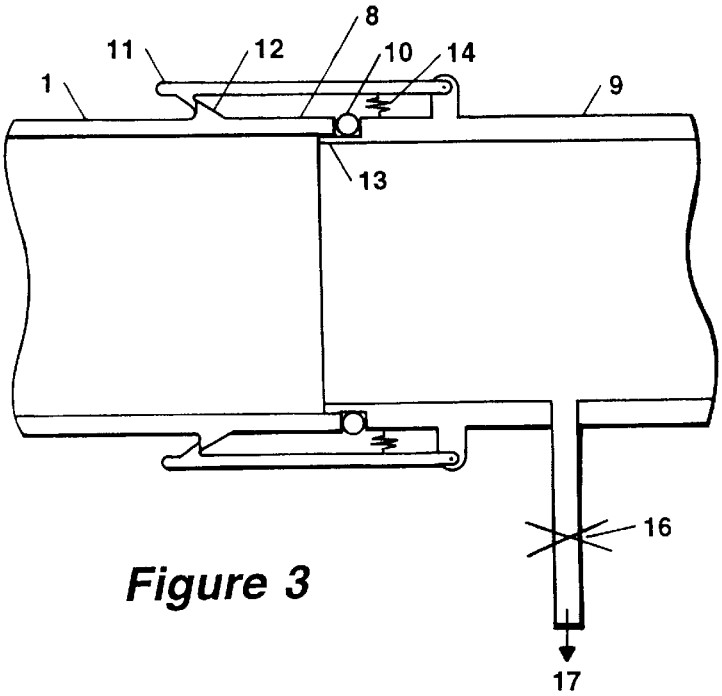

FIG. 3, in a schematic, shows the simple flange mounting of the cassette (1) with the sealing surface (8) via a rubber toroidal sealing ring (10) onto the frame (9) of the entrance opening of the mass spectrometer. Two locking levers (11), biased toward retaining hooks (12) by springs (14), hold the cassette (1) firmly onto the retaining hooks (12), which are attached here rather than the eyelets depicted in FIG. 2 on the cassette (1). The toroidal sealing ring (10) is held by a guidance tongue (13) which also fastens the cassette (1) and the opening frame (9) to one another. The lid closure can be attached in a similar manner. Also shown is a valve (16) which may be opened to allow a vacuum within the cassette to be drawn through port (17).

PARTICULARLY FAVORABLE EMBODIMENTS

The basic design of the invention has already been shown in FIG. 1 as a cross section of the cassette with the sample support contained within and in FIG. 2 as a three-dimensional view.

The cassette is designed in such a way that it can accept the carrier plate into sliding grooves on the inner sides of the cassette. In a favorable embodiment, the sample support projects out of the cassette by about 15 millimeters after introduction. When flange mounting the cassette, the sample support then projects about 15 millimeters into the space in front of the lock-gate valve and can there be grasped easily by two small friction wheels. These small friction wheels can, after the cassette has been evacuated and the lock-gate valve opened, help pull the sample support out of the cassette and insert it in appropriate sliding grooves on the movement device. The sample supports can be fastened either in the cassette or in the movement device. For vacuum-tight flange mounting, a semi-soft rubber seal can be used. In a favorable embodiment, the cassette can be fastened simply to the introduction opening using mechanical spring catches or an automatic snap-in device. A special screwed connection is not necessary, the external air pressure adds a component of force against the inner vacuum, which is sufficient for sealing the cassette. The spring catches or hooks are only there to keep the cassette from falling off after the aeration required for its removal.

The cassette can be sealed, when it is not flange mounted onto the mass spectrometer, with a sealing part which surrounds the projecting part of the sample support. This sealing lid, in a particular embodiment, contains two small, very simply designed gas valves by which the cassette can be filled with protective gas in a flow-through method, for example with dry nitrogen.

The cassettes are shaped in such a way using interlocking profiles that they can be easily stacked either open or closed and cannot easily slide in relation to one another. Laterally attached sliding rails on the cassettes allow the cassettes to be placed in magazines and fastened there. Finally, fastening elements may be attached which join the stacked cassettes to one another.

The cassettes may for example be manufactured of plastic. The inside surface may be metal-coated as a diffusion layer to prevent undesirable vapours escaping from the plastic. For very sensitive samples or MALDI layers, metal cassettes such as diecast cassettes may be used.

The size of the cassettes is determined by the size of the sample supports. In biochemistry and molecular genetics, as described above, microtiter plates have become established for parallel processing of many samples. Today these contain 384 reaction containers on a standardized surface of 72 by 108 millimeters in a 4.5 mm grid. The body of the plate is 80 by 125 millimeters in dimension, with additional 2 millimeter wide sliding rails for insertion in magazines. It is particularly favorable to use these plate sizes for the sample supports as well, since there are already appropriate pipette units and other sample preparation devices. Thus, in the preferred embodiment, the cassette receives sample supports in the size of standard microtiter plates.

One of the techniques for mass parallel preparation of the samples consists in working with pipette devices which already contain 384 capillary pipettes in the above grid size, as described in the concurrent patent application BFA 39/96. Using such multi-pipettes, the samples can be removed simultaneously from the reaction cells on a microtiter plate and transferred to a sample support. This produces a point grid with 4.5 millimeter spacing on the support, although each sample point has a diameter of only 200 micrometers. By cleaning the multipipettes, changing the microtiter plates and repeating this procedure, a second grid of sample spots can be applied, this spot grid being displaced by a small amount from the first one. By repeating this method, 384 sample spot blocks with 8 by 8 spots each (0.5 millimeters spot spacing) or even 10 by 10 spots (at 400 micrometers spot spacing) can be applied to the sample support. This produces sample supports with 24,576 or even 38,400 sample spots, and even then a spacing of 0.5 millimeters still remains between the 384 blocks of spots.

Since the entire cycle of cleaning the multipipettes, changing the microtiter plates and the parallel application of the samples only takes about one minute, the entire charging process for 38,400 samples lasts less than two hours and can therefore be easily performed in one workshift. Measurement in the mass spectrometer, on the other hand, lasts about 22 hours at 2 seconds of analysis time, therefore extending until the next workshift on the following day. This time perspective makes it clear that a complicated automatic supply system for sample supports is generally unnecessary.

We claim:

1. A system for feeding at least one flat sample support with applied analyte samples into a vacuum system of a mass spectrometer, the system comprising:

(a) an evacuable cassette containing the sample support, and (b) an introduction port at the mass spectrometer capable of being connected to the cassette in a vacuum-tight connection, the connection being such that an external surface of the cassette is exposed to an environment outside of a vacuum shared between an interior of the cassette and an interior of the introduction port, while a passage is provided for the introduction of the sample support to the mass spectrometer.

2. A system as in claim 1, wherein the cassette is designed for receiving sample supports in the size of standard microtiter plates.

3. A system as in claim 1, wherein the cassette is flange-mounted to the mass spectrometer with a seal and held by a spring catch.

4. A system as in claim 1, wherein the cassettes are shaped in such a way that they are stackable when not connected to the introduction port.

5. A method of inserting a sample support with surface applied analyte samples into an ion source area of a mass spectrometer, the method comprising;

(a) introducing the sample support into a transportable cassette;

(b) connecting the cassette to an introduction port of the mass spectrometer such that an external surface of the cassette is exposed to an environment outside of a vacuum shared between an interior of the cassette and an interior of the mass spectrometer, while a passage is provided between the cassette and the mass spectrometer;

(c) evacuating the cassette; and (d) transporting the sample support into the mass spectrometer.

6. A method as in claim 5, wherein the cassette is evacuated by exposing it to the environment of ion source region of the mass spectrometer.

7. A method as in claim 5, wherein the cassette is evacuated in step (c) through a vacuum pump line and valve, which are located separately from an opening to an ion source region of the mass spectrometer.

* * * * *